US009443637B2

(12) United States Patent
Mizumoto et al.

(10) Patent No.: US 9,443,637 B2
(45) Date of Patent: Sep. 13, 2016

(54) SEMICONDUCTIVE ROLLER

(71) Applicant: SUMITOMO RUBBER INDUSTRIES, LTD., Kobe-shi, Hyogo (JP)

(72) Inventors: Yoshihisa Mizumoto, Kobe (JP); Takashi Marui, Kobe (JP); Kenichi Kuroda, Kobe (JP)

(73) Assignee: SUMITOMO RUBBER INDUSTRIES, LTD., Kobe-Shi (JP)

( * ) Notice: Subject to any disclaimer, the term of this patent is extended or adjusted under 35 U.S.C. 154(b) by 0 days.

(21) Appl. No.: 14/729,834

(22) Filed: Jun. 3, 2015

(65) Prior Publication Data

US 2015/0355571 A1 Dec. 10, 2015

(30) Foreign Application Priority Data

Jun. 4, 2014 (JP) ..... 2014-115877

(51) Int. Cl.

*G03G 15/08* (2006.01)
*H01B 1/12* (2006.01)
*G03G 15/02* (2006.01)

(52) U.S. Cl.

CPC ..... *H01B 1/122* (2013.01); *G03G 15/0233* (2013.01); *G03G 15/0818* (2013.01); *Y10T 428/31931* (2015.04)

(58) Field of Classification Search

CPC ..... G03G 15/808; G03G 15/0818; G03G 15/0233

See application file for complete search history.

(56) References Cited

U.S. PATENT DOCUMENTS

2004/0106708 A1 6/2004 Mizumoto et al.
2004/0147383 A1* 7/2004 Uesaka ..... G03G 15/0233 492/56
2004/0220301 A1* 11/2004 Hattori ..... H01B 1/122 524/155
2006/0074162 A1 4/2006 Mizumoto et al.
2007/0041752 A1 2/2007 Mizumoto et al.
2007/0110936 A1* 5/2007 Hirakawa ..... B32B 1/08 428/36.8
2011/0229202 A1* 9/2011 Mizumoto ..... G03G 15/0818 399/286
2012/0202663 A1 8/2012 Mizumoto et al.
2013/0288869 A1* 10/2013 Tajima ..... G03G 15/0233 492/18
2016/0041491 A1* 2/2016 Suzuki ..... G03G 15/0233 399/176

FOREIGN PATENT DOCUMENTS

JP 09/114189 A 5/1997
JP 2002/278320 A 9/2002
JP 2004-176056 A 6/2004
JP 2007-072445 A 3/2007
JP 2012-163776 A 8/2012
JP 2013-097117 A 5/2013
JP 2013-117678 A 6/2013

* cited by examiner

*Primary Examiner* — David Gray
*Assistant Examiner* — Carla Therrien
(74) *Attorney, Agent, or Firm* — Birch, Stewart, Kolasch & Birch, LLP

(57) ABSTRACT

A semiconductive roller (1) according to the present invention has a nonporous single-layer structure formed from a rubber composition which includes: a rubber component including a styrene butadiene rubber and an epichlorohydrin rubber; and a salt of an anion having a fluoro group and a sulfonyl group in its molecule; the salt being present in the rubber composition in a proportion of 0.05 to 5 parts by mass based on 100 parts by mass of the overall rubber component.

6 Claims, 1 Drawing Sheet

SEMICONDUCTIVE ROLLER

TECHNICAL FIELD

The present invention relates to a semiconductive roller which is advantageously used particularly as a developing roller or the like in an electrophotographic image forming apparatus.

BACKGROUND ART

In an electrophotographic image forming apparatus such as a laser printer, an electrostatic copying machine, a plain paper facsimile machine or a printer-copier-facsimile multifunction machine, an electrostatic latent image formed on a surface of a photoreceptor body by electrically charging the photoreceptor surface and exposing the photoreceptor surface to light is developed into a toner image with a toner, and a developing roller is used for the development.

There is a trend toward the use of a toner including more uniform, more spherical and smaller size toner particles or a polymeric toner. In order to impart such toner with higher electrical chargeability and efficiently develop the electrostatic latent image into the toner image without adhesion of the toner to the developing roller, it is effective to use, as the developing roller, a semiconductive roller having a roller resistance controlled at not greater than $10^8\Omega$ in an ordinary temperature and ordinary humidity environment at a temperature of 23° C. at a relative humidity of 55%.

To meet various requirements imposed on the semiconductive roller, studies have been made on the type of a rubber component and the types and proportions of additives to be used for the production of the semiconductive roller, the structure of the semiconductive roller, and the like.

For example, the semiconductive roller typically has a nonporous single-layer structure, so that the semiconductive roller can be produced at a higher productivity at lower costs as having an improved durability and an improved compression set property.

It is considered preferable to produce the semiconductive roller by using a rubber composition containing a rubber component including at least an ion conductive rubber such as an epichlorohydrin rubber in order to suppress reduction in toner charge amount and toner transport amount to ensure higher quality image formation when the semiconductive roller is used as the developing roller.

Problematically, where the semiconductive roller is used as the developing roller, a formed image is liable to have a reduced image density. This is because the ion conductive rubber such as the epichlorohydrin rubber is highly adhesive to the toner.

Patent Document 1 proposes that titanium oxide functioning to prevent the adhesion of the toner is added to the rubber composition containing the ion conductive rubber as the rubber component for the semiconductive roller in order to suppress the image density reduction attributable to the toner adhesion to provide a proper image density.

If titanium oxide (a filler having a higher hardness) is added to the rubber composition in an amount sufficient to ensure the aforementioned function, however, the semiconductive roller is liable to have an increased hardness to cause additional problems. More specifically, the semiconductive roller is liable to deteriorate the toner to reduce imaging durability, or liable to have a reduced nip width when being in press contact with the surface of the photoreceptor body. Thus, the formed image is liable to have a reduced image quality.

The term "imaging durability" is defined as an index that indicates how long the image formation quality can be properly maintained when the same toner is repeatedly used for the image formation.

A very small part of toner contained in a developing section of the image forming apparatus is used in each image forming cycle, and the remaining major part of the toner is repeatedly circulated in the developing section. Since the developing roller is provided in the developing section and repeatedly brought into contact with the toner, whether or not the developing roller can reduce damage to the toner is a key factor to the improvement of the imaging durability. If the imaging durability is reduced, the formed image is liable to have white streaks in its black solid portion or have fogging in its marginal portion, thereby having a reduce image quality.

Patent Document 2 proposes a semiconductive roller having a double layer structure including an electrically conductive elastic layer, and a surface layer provided on an outer peripheral surface of the electrically conductive elastic layer, having a sea-island structure formed from a mixture of an acrylonitrile butadiene rubber (NBR) and a styrene butadiene rubber (SBR) incompatible with each other and imparted with ion conductivity by addition of an electrically conductive agent of an ion conductive type.

Examples of the electrically conductive agent of the ion conductive type include lithium perchlorate, sodium perchlorate, calcium perchlorate and perchlorates of long-chain-alkyl quaternary ammoniums.

It is conceivable to form the semiconductive roller having the single layer structure by employing the arrangement of the surface layer. In this case, it is possible to maintain, the roller resistance at a lower level by the addition of the electrically conductive agent of the ion conductive type while preventing the adhesion of the toner without the use of the ion conductive rubber.

In this case, however, the ion conductive agent should be added in a greater amount based on the overall amount of the rubber component in order to maintain the roller resistance at the lower level.

Therefore, when the semiconductive roller is continuously subjected to an electric field or a higher temperature, for example, an excess amount of the ion conductive agent is liable to bleed on an outer peripheral surface of the semiconductive roller. Problematically, the bleeding ion conductive agent is transferred to the photoreceptor body and the like to contaminate the photoreceptor body, thereby reducing the image quality of the formed image.

Patent Document 3 proposes a semiconductive roller having a double layer structure including an elastic layer formed from a mixture of an ethylene propylene diene rubber (EPDM), an NBR and an SBR and containing an electrically conductive carbon black as an electrically conductive agent of an electron conductive type, and a surface layer of a fluorine-containing material provided on an outer peripheral surface of the elastic layer.

Where the semiconductive roller is to be imparted with electron conductivity by using the electrically conductive carbon black alone as the electrically conductive agent, however, the semiconductive roller should have the layered structure including the surface layer covering the outer peripheral surface as described above to stabilize the roller resistance. That is, the semiconductive roller is not allowed to have a single layer structure, thereby requiring an increased number of production steps and an increased number of materials. Problematically, this correspondingly reduces the productivity of the semiconductive roller and increases the production costs.

Patent Document 4 proposes a semiconductive roller formed by using an SBR in combination with an epichlorohydrin rubber (ion conductive rubber) as a rubber component.

This arrangement provides the following effects:

The combinational use of the SBR reduces the amount of the epichlorohydrin rubber which may cause the adhesion of the toner, thereby suppressing the reduction in image density due to the toner adhesion.

It is possible to obviate the need for blending titanium oxide or to reduce the blending amount titanium oxide as compared with the prior art to impart the semiconductive roller with flexibility, thereby improving the toner imaging durability.

CITATION LIST

Patent Documents

Patent Document 1: JP2007-72445A
Patent Document 2: JP-HEI9 (1997)-114189A
Patent Document 3: JP2002-278320A
Patent Document 4 JP2012-153776A

SUMMARY OF THE INVENTION

Problem to be Solved by the Invention

Where the semiconductive roller produced by using the SBR and the epichlorohydrin rubber in combination as the rubber component as described in Patent Document 4 is incorporated as the developing roller in an image forming apparatus (lower speed apparatus), for example, having an image formation speed of less than about 25 sheet/minute, the semiconductive roller can be used without any problem and properly provide the aforementioned effects.

However, where the semiconductive roller is incorporated as the developing roller in an image forming apparatus (intermediate to higher speed apparatus) for example, having an image formation speed of not less than 25 sheets/minute, a problem arises. That is, when the image forming apparatus is switched on to resume the image formation after a certain stand-still period (e.g., not shorter than three days) from the previous switch-off of the apparatus, the first image formed immediately after the resumption of the image formation has a significantly reduced image density in its black solid portion.

This is because the roller resistance of the semiconductive roller is influenced by the environment (temperature and humidity) to significantly vary. That is the roller resistance of the semiconductive roller tends to be increased as the temperature and the humidity are reduced. The roller resistance of the semiconductive roller tends to be reduced as the temperature and the humidity are increased.

The internal environment of the image forming apparatus in which the semiconductive roller is incorporated is not always constant. When the image forming apparatus is switched on after a certain stand-still period as described above, for example, the temperature and the humidity inside the image forming apparatus are increased from the stand-still conditions by warming up the image forming apparatus and the roller resistance of the semiconductive roller is correspondingly gradually reduced.

The lower speed apparatus has an enough period before the image formation is resumed through the warming up of the apparatus after the switch-on of the apparatus. During this period, the temperature and the humidity inside the apparatus are sufficiently increased to ordinary operation temperature and humidity levels. Therefore, the roller resistance of the semiconductive roller is generally an ordinary operation roller resistance level when the image formation is resumed. Accordingly, the first image formed immediately after the resumption of the image formation is prevented from having a significantly reduced image density in its black solid portion.

In the intermediate to higher speed apparatus, however, the period required for the resumption of the image formation after the switch-on of the apparatus is generally set shorter for reduction of a startup period.

When the image forming apparatus is switched on after being allowed to stand still in the lower temperature and lower humidity environment particularly in winter, the roller resistance of the semiconductive roller is higher than the ordinary operation roller resistance level because the temperature and the humidity inside the apparatus are not sufficiently increased and, in this state, the image formation is resumed. Therefore, the first image formed immediately after the resumption of the image formation is liable to have a significantly reduced image density in its black solid portion.

If the proportion of the epichlorohydrin rubber in the rubber component is increased, the roller resistance of the semiconductive roller in the lower temperature and lower humidity environment can be reduced to a certain extent.

In this case, however, the formulation of the rubber composition contributable to the toner electric chargeability is changed and, therefore, the toner charge amount and the toner transport amount are changed when the semiconductive roller is used as the developing roller. Further, the effect of the combinational use of the SBR cannot be sufficiently provided, so that the semiconductive roller is liable to suffer from the adhesion of the toner and, hence, the reduction in image density.

It is also conceivable to control the roller resistance of the semiconductive roller by adding the electrically conductive carbon black to the rubber composition. In this case, however, the electrically conductive carbon black (which also functions as a filler and a rubber reinforcing material) should be added to the rubber composition in a great amount on the order of 20 parts by mass or greater based on 100 parts by mass of the overall rubber component. This increases the hardness of the semiconductive thereby reducing the toner imaging durability.

It is an object of the present invention to provide a novel semiconductive roller which has a lower-temperature lower-humidity roller resistance controllable to a roller resistance level optimal for an image forming apparatus incorporating the semiconductive roller as a developing roller or the like without significant variations in hardness and other mechanical properties, toner charge amount, toner transport amount and other electrical properties, without the reduction in image density due to the adhesion of toner and without the reduction in formed image quality due to the contamination of a photoreceptor body, and is capable of suppressing the environment-dependent variations in roller resistance, so that an image formed with the use of the semiconductive roller is substantially free from the reduction in image density in its black solid portion.

Solution to Problem

The present invention provides a semiconductive roller having a nonporous single-layer structure formed from a rubber composition which includes a rubber component including an SBR and an epichlorohydrin rubber, and a salt of an anion having a fluoro group and a sulfonyl group in its molecule, the salt being present in the rubber composition in a proportion of not less than 0.05 parts by mass and not greater than 5 parts by mass based on 100 parts by mass of the overall rubber component.

Effects of the Invention

The salt of the anion having the fluoro group and the sulfonyl group in its molecule (hereinafter sometimes referred to as "ionic salt") functions as an ion conductive agent to reduce the roller resistance of the semiconductive roller without significant variations in hardness and other mechanical properties unlike the electrically conductive carbon black.

According to the present invention, therefore, the combinational use of the ionic salt and the epichlorohydrin rubber obviates the need for blending the electrically conductive carbon black, or reduces the blending proportion of the electrically conductive carbon black as compared with the prior art. In addition, the combinational use prevents the semiconductive roller of the nonporous single-layer structure from suffering from significant variations in hardness and other mechanical properties.

In the present invention, the ionic salt is used in combination with the epichlorohydrin rubber (ion conductive rubber), so that the blending proportion of the ionic salt can be limited to the aforementioned range. Particularly, where the semiconductive roller is used as the developing roller, it is possible to prevent the contamination of the photoreceptor body and the like and, hence, the reduction in the image quality of the formed image, which may otherwise occur due to the bleeding of an excess amount of the ionic salt.

According to the present invention, in addition, the formulation of the rubber composition is maintained substantially constant, while only the blending proportion of the ionic salt is controlled within the aforementioned range. Thus, the roller resistance of the semiconductive roller, particularly in the lower temperature and lower humidity environment, can be controlled at a roller resistance level optimal for the image forming apparatus incorporating the semiconductive roller as the developing roller or the like without significant variations in toner charge amount, toner transport amount and other electrical properties and without reduction in image density due to the toner adhesion. Further, the environment-dependent variations in roller resistance can be suppressed.

Therefore, even if the semiconductive roller is incorporated as the developing roller in the intermediate to higher speed apparatus and the apparatus is switched on to resume the image formation after a certain stand-still period, the first image formed immediately after the resumption of the image formation is prevented from having a significantly reduced image density in its black solid portion.

EMBODIMENTS OF THE INVENTION

Figure 1:
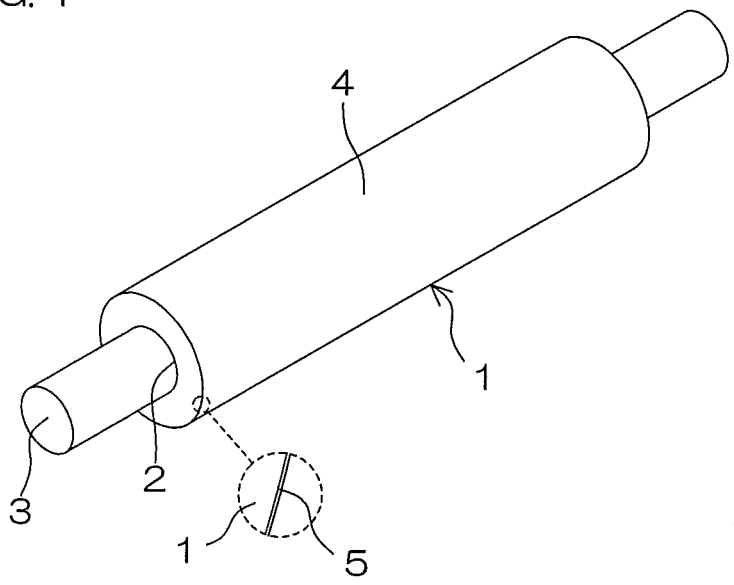
FIG. 1 is a perspective view illustrating an exemplary semiconductive roller according to an embodiment of the present invention.

A semiconductive roller according to the present invention has a nonporous single-layer structure formed from a rubber composition which includes a rubber component including an SBR and an epichlorohydrin rubber, and not less than 0.05 parts by mass and not greater than 5 parts by mass of an ionic salt based on 100 parts by mass of the overall rubber component.

<<Rubber Composition>>

<Rubber Component>

As described above, at least the SBR and the epichlorohydrin rubber are used in combination as the rubber component.

(SBR)

Usable as the SBR are various SBRs synthesized by copolymerizing styrene and 1,3-butadiene by an emulsion polymerization method, a solution polymerization method and other various polymerization methods. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable. Physical properties of the semiconductive roller can be controlled by changing the styrene content and the crosslinking degree.

These SBRs may be used either alone or in combination.

The proportion of the SBR to be blended is preferably not less than 10 parts by mass and not greater than 80 parts by mass, particularly preferably not less than 30 parts by mass and not greater than 70 parts by mass, based on 100 parts by mass of the overall rubber component.

If the proportion of the SBR is less than the aforementioned range, the proportion of the epichlorohydrin rubber is relatively increased. Therefore, when the semiconductive roller is used as a developing roller, toner is liable to adhere to the developing roller, resulting in reduction in the image density of a formed image.

If the proportion of the SBR is greater than the aforementioned range, the proportion of the epichlorohydrin rubber is relatively reduced, thereby increasing the roller resistance. Therefore, when the semiconductive roller is used as the developing roller, the toner charge amount and the toner transport amount are liable to be reduced.

Where an oil-extension type SBR is used, the proportion of the SBR described above is defined as the solid proportion of the SBR contained in the oil-extension type SBR.

(Epichlorohydrin Rubber)

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used either alone or in combination.

Of these epichlorohydrin rubbers, the ethylene oxide-containing copolymers, particularly the ECO and/or the GECO are preferred as the epichlorohydrin rubber.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance of the semiconductive roller.

If the ethylene oxide content is greater than the aforementioned range, on the other hand, ethylene oxide is liable to be crystallized, whereby the segment motion of molecular chains is hindered to adversely increase the roller resistance of the semiconductive roller. Further, the semiconductive roller is liable to have a higher hardness after the crosslinking, and the rubber composition is liable to have a higher viscosity when being heat-melted before the crosslinking. Therefore, the processability is liable to be reduced.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance of the semiconductive roller.

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered. This may adversely increase the roller resistance of the semiconductive roller. Further, the semiconductive roller is liable to suffer from reduction in tensile strength, fatigue resistance and flexural resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The proportion of the epichlorohydrin rubber to be blended is preferably not less than 5 parts by mass and not greater than 50 parts by mass, particularly preferably not less than 10 parts by mass and not greater than 30 parts by mass, based on 100 parts by mass of the overall rubber component.

If the proportion of the epichlorohydrin rubber is less than the aforementioned range, the semiconductive roller is liable to have an increased roller resistance and, hence, a reduced toner charge amount and a reduced toner transport amount when being used as the developing roller.

If the proportion of the epichlorohydrin rubber is greater than the aforementioned range, on the other hand, the semiconductive roller is liable to suffer from the toner adhesion when being used as the developing roller, resulting in reduction in the image density of the formed image.

<Additional Rubber for Rubber Component>

At least one selected from the group consisting of an NBR, a chloroprene rubber (CR), a butadiene rubber (BR), an acryl rubber (ACM) and an EPDM may be additionally used for the rubber component.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Either type of NBRs is usable.

These NBRs may be used either alone or in combination.

(CR)

The CR is synthesized, for example, by polymerizing chloroprene by an emulsion polymerization method. The CR is classified in a sulfur modification type or a non-sulfur-modification type depending on the type of a molecular weight adjusting agent to be used for the emulsion polymerization. Either type of CRs is usable in the present invention.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of these types of CRs may be used. Particularly, CRs of the non-sulfur-modification type and the lower crystallization speed type are preferably used either alone or in combination.

Further, a rubber of a copolymer of chloroprene and other comonomer may be used as the CR.

Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used either alone or in combination.

(BR)

Usable as the BR are various crosslinkable BRs.

Particularly, a higher cis-content BR having a cis-1,4 bond content of not less than 95% and having excellent lower-temperature characteristic properties and a lower hardness and hence a higher flexibility in the lower temperature and lower humidity environment is preferred.

The BRs include those of an oil-extension type having flexibility controlled by addition of an extension oil, and those of a non-oil-extension type containing no extension oil. Either type of BRs is usable.

These BRs may be used either alone or in combination.

(ACM)

Usable as the ACM are various ACMs each synthesized by copolymerizing an alkyl acrylate such as ethyl acrylate or butyl acrylate as a major component with acrylonitrile, a halogen-containing monomer such as 2-chloroethyl vinyl ether, or glycidyl acrylate, allyl glycidyl ether, ethylidene norbornene or the like.

These ACMs may be used either alone or in combination.

(EPDM)

Usable as the EPDM are various EPDMs each prepared by introducing double bonds into a main chain thereof by employing a small amount of a third ingredient (diene) in addition to ethylene and propylene. A variety of EPDM products containing different types of third ingredients in different amounts are commercially available. Typical examples of the third ingredients include ethylidene norbornene (ENB), 1,4-hexadiene (1,4-HD) and dicyclopentadiene (DCP). A Ziegler catalyst is typically used as a polymerization catalyst.

The EPDMs include those of an oil-extension type having flexibility controlled by addition of an extension oil, and those of a non-oil-extension type containing no extension oil. Either type of EPDMs is usable.

These EPDMs may be used either alone or in combination.

(Blending Proportion)

The CR is particularly preferred as the additional rubber for the rubber component. As described above, the CR functions to finely control the roller resistance of the semiconductive roller as well as to finely control the toner charge amount and the toner transport amount when the semiconductive roller is used as the developing roller. In addition, the CR functions to increase the flexibility of the semiconductive roller to improve the toner imaging durability.

The proportion of the CR to be blended is preferably not less than 5 parts by mass and not greater than 50 parts by mass, particularly preferably not less than 10 parts by mass and not greater than 40 parts by mass, based on 100 parts by mass of the overall rubber component.

If the proportion of the CR is less than the aforementioned range, it will be impossible to sufficiently provide the effect of the addition of the CR described above.

If the proportion of the CR is greater than the aforementioned range, on the other hand, the proportion of the epichlorohydrin rubber is relatively reduced to increase the roller resistance. Therefore, the semiconductive roller is liable to have a reduced toner charge amount and a reduced toner transport amount when being used as the developing roller.

<Ionic Salt>

The ionic salt includes an anion having a fluoro group and a sulfonyl group in its molecule. Examples of the anion include fluoroalkyl sulfonate ions, bis(fluoroalkylsulfonyl) imide ions, tris(fluoroalkylsulfonyl)methide ions, which may be used either alone or in combination.

Examples of the fluoroalkyl sulfonate ions include $CF_3SO_3$— and $C_4F_9SO_3$—, which may be used either alone or in combination.

Examples of the bis(fluoroalkylsulfonyl)imide ions include $(CF_3SO_2)_2N$—, $(C_2F_5SO_2)_2N$—, $(C_4F_9SO_2)(CF_3SO_2)N$—, $(FSO_2C_6F_4)(CF_3SO_2)N$—, $(C_8F_{17}SO_2)(CF_3SO_2)N$—, $(CF_3CH_2OSO_2)_2N$—, $(CF_3CF_2CH_2OSO_2)_2N$—, $(HCF_2CF_2CH_2OSO_2)_2N$— and $[(CF)_2CHOSO_2]_2N$—, which may be used either alone or in combination.

Examples of the tris(fluoroalkylsulfonyl)methide ions include $(CF_3SO_2)_3C$— and $(CF_3CH_2OSO_2)_3C$—, which may be used either alone or in combination.

Specific examples of a cation which forms the ionic salt together with the anion include cations of alkali metals such as sodium, lithium and potassium, cations of Group II elements such as beryllium, magnesium, calcium, strontium and barium, cations of transition elements, cations of amphoteric elements, quaternary ammonium cations represented by the following formula (1) and cations represented by the following formula (2), which may be used either alone or in combination:

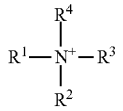

(1)

wherein $R^1$ to $R^4$, which may be the same or different, are each a C1 to C20 alkyl group or a derivative of the alkyl group.

Particularly, a quaternary ammonium cation of a trimethyl type represented by the formula (1) in which three of $R^1$ to $R^4$ are methyl groups and the other of $R^1$ to $R^4$ is a C4 to C20 alkyl group, more preferably a C6 to C20 alkyl group or its derivative is preferred.

A positive charge on a nitrogen atom of the cation is stabilized by the three methyl groups which are strong electron donating groups, and the compatibility of the ionic salt with the rubber component is improved by the other alkyl group or its derivative. This stabilizes the positive charge on the nitrogen atom to increase the stability of the cation, thereby providing an ionic salt having a higher dissociation degree and a higher electrical conductivity imparting capability.

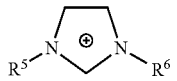

(2)

wherein $R^5$ and $R^6$, which may be the same or different, are each a C1 to C20 alkyl group or its derivative.

Particularly, $R^5$ and $R^6$ are each preferably a methyl group or an ethyl group which has an electron donating property and therefore is capable of easily stabilizing the positive charge on the nitrogen atom. This increases the stability of the cation to provide an ionic salt having a higher dissociation degree and an excellent electrical conductivity imparting capability.

Particularly preferred as the ionic salt is a lithium salt including a lithium ion as the cation or a potassium salt including a potassium ion as the cation.

Particularly, $(CF_3SO_2)_2NLi$ (lithium bis(trifluoromethanesulfonyl)imide) and $(CF_3SO_2)_2NK$ (potassium bis(trifluoromethanesulfonyl)imide) are preferred, because they improve the ion conductivity of the semiconductive roller and are capable of controlling the lower-temperature lower-humidity roller resistance of the semiconductive roller at a roller resistance level optimal for an image forming apparatus incorporating the semiconductive roller as the developing roller and suppressing the environment-dependent variations in roller resistance.

In comparison between these salts, the lithium salt is more excellent in resistance reducing effect and handlability because of its lower water absorbability during storage. Which of these ionic salts is to be used is preferably determined in comprehensive consideration of the resistance reducing effect, the handlability and other properties required for the semiconductive roller.

The proportion of the ionic salt to be blended should be not less than 0.05 parts by mass and not greater than 5 parts by mass based on 100 parts by mass of the overall rubber component.

If the proportion of the ionic salt is less than the aforementioned range, it will be impossible to provide the effect of the blending of the ionic salt, i.e., it will be impossible to control the lower-temperature lower-humidity roller resistance of the semiconductive roller at a roller resistance level optimal for the image forming apparatus incorporating the semiconductive roller as the developing roller and to suppress the environment-dependent variations in roller resistance.

If the proportion of the ionic salt is greater than the aforementioned range, on the other hand, an excess amount of the ionic salt is liable to bleed on the outer peripheral surface of the semiconductive roller to contaminate the photoreceptor body and the like, thereby reducing the formed image quality. Further, the addition of the excess amount of the ionic salt increases the production costs of the semiconductive roller.

Where the proportion of the ionic salt falls within the aforementioned range, in contrast, it is possible to control the lower-temperature lower-humidity roller resistance of the semiconductive roller at a roller resistance level optimal for the image forming apparatus incorporating the semiconductive roller as the developing roller and suppress the environment-dependent variations in roller resistance, while advantageously preventing the contamination of the photoreceptor body and the like and suppressing the increase in the production costs of the semiconductive roller.

For further improvement of these effects, the proportion of the ionic salt is preferably not less than 0.1 part by mass and not greater than 2 parts by mass within the aforementioned range based on 100 parts by mass of the overall rubber component.

<Crosslinking Component>

The rubber composition includes a crosslinking component for crosslinking the rubber component. The crosslinking component includes a crosslinking agent, an accelerating agent and an acceleration assisting agent.

Examples of the crosslinking agent include a sulfur crosslinking agent, a thiourea crosslinking agent, a triazine derivative crosslinking agent, a peroxide crosslinking agent and monomers, which may be used either alone or in combination.

Examples of the sulfur crosslinking agent include sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is an integer of 1 to 10), which may be used either alone or in combination.

Examples of the peroxide crosslinking agent include benzoyl peroxide and the like.

The sulfur and the thiourea crosslinking agent are preferably used in combination as the crosslinking agent.

The proportion of the sulfur to be used in combination with the thiourea crosslinking agent is preferably not less than 0.2 parts by mass and not greater than 3 parts by mass, particularly preferably not less than 0.5 parts by mass and not greater than 1 part by mass, based on 100 parts by mass of the overall rubber component.

If the proportion of the sulfur is less than the aforementioned range, the crosslinking speed of the overall rubber composition is liable to be reduced, requiring a longer crosslinking period. This may reduce the productivity of the semiconductive roller.

If the proportion of the sulfur is greater than the aforementioned range, the semiconductive roller is liable to have a greater compressive permanent set after the crosslinking, and an excess amount of the sulfur is liable to bloom on the outer peripheral surface of the semiconductive roller to contaminate the photoreceptor body and the like.

The proportion of the thiourea crosslinking agent to be blended is preferably not less than 0.1 part by mass and not greater than 3 parts by mass, more preferably not less than 0.2 parts by mass, particularly preferably not less than 0.5 parts by mass and not greater than 1 part by mass, based on 100 parts by mass of the overall rubber component.

The combinational use of the sulfur and the thiourea crosslinking agent relatively reduces the proportion of the sulfur in the aforementioned range, making it possible to reduce the compressive permanent set of the semiconductive roller.

Since the thiourea crosslinking agent hardly hinders the molecular motion of the rubber, the roller resistance of the semiconductive roller can be further reduced. Particularly, the roller resistance of the semiconductive roller is reduced, as the crosslinking density is increased by increasing the proportion of the thiourea crosslinking agent in the aforementioned range.

If the proportion of the thiourea crosslinking agent is less than the aforementioned range, however, it will be impossible to sufficiently provide the effects of the combinational use of the thiourea crosslinking agent and the sulfur.

If the proportion of the thiourea crosslinking agent is greater than the aforementioned range, on the other hand, an excess amount of the thiourea crosslinking agent is liable to bloom on the outer peripheral surface of the semiconductive roller to contaminate the photoreceptor body and the like, or the breaking elongation and other mechanical properties of the semiconductive roller are liable to be reduced.

Examples of the accelerating agent include inorganic accelerating agents such as lime, magnesia (MgO) and litharge (PbO), and organic accelerating agents, which may be used either alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used either alone or in combination.

Different types of accelerating agents have different functions and, therefore, are preferably used in combination.

The proportion of the accelerating agent to be blended may be properly determined depending on the type of the accelerating agent, but is preferably not less than 0.1 part by mass and not greater than 5 parts by mass, particularly preferably not less than 0.2 parts by mass and not greater than 2 parts by mass, based on 100 parts by mass of the overall rubber component.

Examples of the acceleration assisting agent include: metal compounds such as zinc whiter fatty acids such as stearic acid, oleic acid and cotton seed fatty acids; and other conventionally known acceleration assisting agents, which may be used either alone or in combination.

The proportion of the acceleration assisting agent to be blended is preferably not less than 0.1 part by mass and not greater than 7 parts by mass, particularly preferably not less than 0.5 parts by mass and not greater than 5 parts by mass, based on 100 parts by mass of the overall rubber component.

<Other Ingredients>

As required, various additives may be added to the rubber composition. Examples of the additives include an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent, a co-crosslinking agent and the like.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 4 parts by mass, based on 100 parts by mass of the overall rubber component.

If the proportion of the acid accepting agent is less than the aforementioned range, it will be impossible to sufficiently provide the effect of the blending of the acid accepting agent. If the proportion of the acid accepting agent is greater than the aforementioned range, the semiconductive roller is liable to have an increased hardness after the crosslinking.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be blended is preferably not greater than 5 parts by mass based on 100 parts by mass of the overall rubber component. This prevents the contamination of the photoreceptor body, for example, when the semiconductive roller is mounted in the image forming apparatus or when the image forming apparatus is operated. For this purpose, it is particularly preferred to use any of the polar waxes out of the plasticizing agent.

Examples of the degradation preventing agent include various anti-aging agents and anti-oxidants.

The anti-oxidants serve to reduce the environmental dependence of the roller resistance of the semiconductive roller and to suppress the increase in roller resistance during continuous energization of the semiconductive roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Examples of the filler include zinc oxide, silica, carbon, carbon black, clay, talc, calcium carbonate, magnesium carbonate and aluminum hydroxide, which may be used either alone or in combination.

The mechanical strength and the like of the semiconductive roller can be improved by blending the filler.

The proportion of the filler to be blended is preferably not less than 5 parts by mass and not greater than 25 parts by mass, particularly preferably not greater than 20 parts by mass, based on 100 parts by mass of the overall rubber component.

An electrically conductive filler such as electrically conductive carbon black may be blended as the filler to impart the semiconductive roller with electron conductivity.

A preferred example of the electrically conductive carbon black is HAF. The HAF can be evenly dispersed in the rubber composition, thereby imparting the semiconductive roller with more uniform electron conductivity.

The proportion of the electrically conductive carbon black to be blended is preferably not less than 1 part by mass and not greater than 30 parts by mass, particularly preferably not less than 3 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-metyl-1-pentene, which may be used either alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used either alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers may be used either alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used either alone or in combination.

The rubber composition containing the ingredients described above can be prepared in a conventional manner. First, the rubbers for the rubber component are blended in the predetermined proportions, and the resulting rubber component is simply kneaded. After the ionic salt and additives other than the crosslinking component are added to and kneaded with the rubber component, the crosslinking component is finally added to and further kneaded with the resulting mixture. Thus, the rubber composition is provided. A kneader, a Banbury mixer, an extruder or the like, for example, is usable for the kneading.

<<Semiconductive Roller>>

FIG. 1 is a perspective view illustrating an exemplary semiconductive roller according to one embodiment of the present invention.

Referring to FIG. 1, the semiconductive roller 1 according to this embodiment is produced by forming the aforementioned rubber composition into a tubular body having a nonporous single-layer structure, inserting a shaft 3 through a center through-hole 2 of the tubular body, and fixing the shaft 3 to the tubular body.

The shaft 3 is a unitary member made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

As shown in FIG. 1 on an enlarged scale, an oxide film 5 may be provided in an outer peripheral surface 4 of the semiconductive roller 1.

The oxide film 5 thus provided functions as a dielectric layer to reduce the dielectric dissipation factor of the semiconductive roller 1. Where the semiconductive roller 1 is used as the developing roller, the oxide film 5 serves as a lower friction layer to further suppress the toner adhesion.

In addition, the oxide film 5 can be easily formed by irradiation with ultraviolet radiation in an oxidizing atmosphere, thereby suppressing the reduction in the productivity of the semiconductive roller 1 and the increase in production costs. However, the oxide film 5 may be obviated.

The semiconductive roller 1 is produced by extruding the preliminarily prepared rubber composition into a tubular body by means of an extruder, cutting the tubular body to a predetermined length, and heating the resulting tubular body in a vulcanization can to crosslink the tubular body.

The tubular body thus crosslinked is heated in an oven for secondary crosslinking, then cooled, and polished to a predetermined outer diameter.

Any of various polishing methods such as a dry traverse grinding method may be employed for the polishing. Where the outer peripheral surface 4 is mirror-finished to a surface roughness (ten-point average roughness Rz) of not greater than 10.0 μm as measured in conformity with Japanese Industrial Standards JIS $B0601_{__1994}$, for example, by a wet paper polishing method or by a dry plunge grinding method (dry oscillation polishing method which employs a grindstone extending along the entire width of the outer peripheral surface 4) at the end of the polishing step, the releasability of the outer peripheral surface is improved, thereby suppressing the toner adhesion even without the provision of the oxide film 5. Thus, the contamination of the photoreceptor body and the like can be effectively prevented.

Where the outer peripheral surface is mirror-finished to a surface roughness in the aforementioned range and further formed with the oxide film 5, a synergetic effect of the mirror-finishing and the formation of the oxide film 5 more advantageously suppresses the toner adhesion, and further more advantageously prevents the contamination of the photoreceptor body.

The shaft 3 may be inserted into and fixed to the through-hole 2 at any time between the end of the cutting of the tubular body and the end of the polishing.

However, the semiconductive roller 1 is preferably secondarily crosslinked and polished with the shaft 3 inserted through the through-hole 2 after the cutting. This prevents warpage and deformation of the semiconductive roller 1 which may otherwise occur due to expansion and contraction of the semiconductive roller 1 during the secondary crosslinking. The outer peripheral surface 4 of the semiconductive roller 1 is polished, while the semiconductive roller 1 is rotated about the shaft 3. This improves the working efficiency in the polishing, and suppresses deflection of the outer peripheral surface 4.

As previously described, the shaft 3 having an outer diameter greater than the inner diameter of the through-hole 2 may be press-inserted into the through-hole 2, or the shaft 3 may be inserted through the through-hole 2 of the semiconductive roller 1 with the intervention of the electrically conductive thermosetting adhesive agent before the secondary crosslinking.

In the latter case, the thermosetting adhesive agent is cured when the tubular body is secondarily crosslinked by the heating in the oven. Thus, the shaft 3 is electrically connected to and mechanically fixed to the semiconductive roller 1.

In the former case, the electrical connection and the mechanical fixing are achieved simultaneously with the press insertion.

The formation of the oxide film 5 is preferably achieved by the irradiation of the outer peripheral surface 4 of the semiconductive roller 1 with the ultraviolet radiation, because this method is simple and efficient. That is, the formation of the oxide film 5 is achieved by irradiating a part of the rubber composition present in the outer peripheral surface 4 of the semiconductive roller 1 with ultraviolet radiation having a predetermined wavelength to oxidize the irradiated part of the rubber composition.

Since the formation of the oxide film 5 is achieved through the oxidation of the part of the rubber composition present in the outer peripheral surface 4 of the semiconductive roller 1 by the irradiation with the ultraviolet radiation, the resulting oxide film 5 is free from the problems associated with a coating film formed in a conventional manner by applying a coating agent, and highly uniform in thickness and surface geometry.

The wavelength of the ultraviolet radiation to be used for the irradiation is preferably not less than 100 nm and not greater than 400 nm, particularly preferably not greater than 300 nm, for efficient oxidation of the rubber composition and for the formation of the oxide film 5 excellent in the aforementioned functions. An irradiation period is preferably not shorter than 30 seconds and not longer than 30 minutes, particularly preferably not shorter than 1 minute and not longer than 15 minutes.

The formation of the oxide film 5 may be achieved by the other method, or may be obviated in some case.

The semiconductive roller 1 having the nonporous single-layer structure preferably has a Shore-A hardness of not greater than 60, particularly preferably not greater than 50.

If the Shore-A hardness is greater than the aforementioned range, the semiconductive roller 1 has an insufficient flexibility, thereby failing to sufficiently provide the effect of improving the toner developing efficiency by providing a sufficient nip width and the effect of reducing the damage to the toner to improve the imaging durability.

In the present invention, the Shore-A hardness is determined at a temperature of 23° C. with a load of 1000 g applied to opposite ends in conformity with Japanese Industrial Standards JIS K6253-3$_{__2012}$.

The semiconductive roller 1 preferably has a roller resistance $R_{NN}$ of not less than $10^4\Omega$ and not greater than $10^8\Omega$, particularly preferably not less than $10^{6.5}\Omega$, as measured with an application voltage of 1000 V in an ordinary temperature and ordinary humidity environment at a temperature of 23° C. at a relative humidity of 55%.

If the roller resistance $R_{NN}$ is less than the aforementioned range, the lower-resistance semiconductive roller 1 is liable to leak the charge of the toner when being used as the developing roller. Therefore, where the charge is leaked along the surface of the formed image, for example, the formed image is liable to have a reduced resolution.

If the roller resistance $R_{NN}$ is greater than the aforementioned range, the higher-resistance semiconductive roller 1 fails to form an image having a sufficient image density.

The semiconductive roller 1 has a roller resistance $R_{LL}$ as measured with an application voltage of 1000 V in a lower temperature and lower humidity environment at a temperature of 10° C. at a relative humidity of 20% and a roller resistance $R_{HH}$ as measured with an application voltage of 1000 V in a higher temperature and higher humidity environment at a temperature of 30° C. at a relative humidity of 80%, and a difference between a log $R_{LL}$ value and a log $R_{HH}$ value is preferably not greater than 1.3. Thus, the environment-dependent variations in roller resistance is minimized and, particularly when the semiconductive roller 1 is used as the developing roller in the intermediate to higher speed apparatus, the first image formed immediately after resumption of the image formation is substantially prevented from having a reduced image density in its black solid portion.

Where the semiconductive roller 1 has the oxide film 5 in the outer peripheral surface 4 thereof, the roller resistance is measured in this state.

<<Roller Resistance Measuring Method>>

Figure 2:
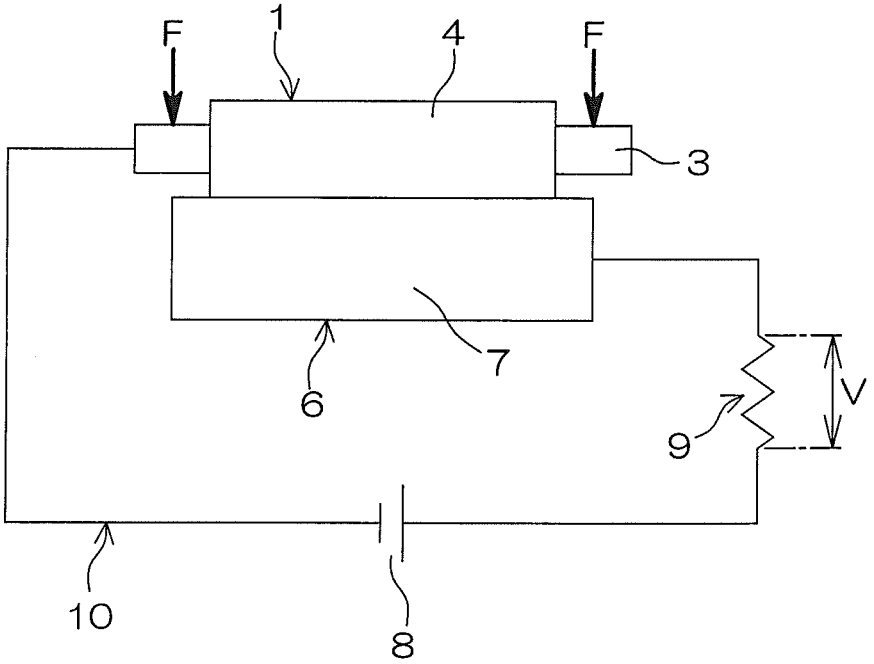
FIG. 2 is a diagram for explaining how to measure the roller resistance of the semiconductive roller.

FIG. 2 is a diagram for explaining how to measure the roller resistance of the semiconductive roller 1.

Referring to FIGS. 1 and 2, the roller resistances of the semiconductive roller 1 are expressed as values determined in the following manner in the aforementioned three environments with an application voltage of 1000 V in the present invention.

An aluminum drum 6 rotatable at a constant rotation speed is prepared, and the outer peripheral surface 4 (formed with the oxide film 5) of the semiconductive roller 1 to be subjected to the roller resistance measurement is brought into contact with an outer peripheral surface 7 of the aluminum drum 6 from above.

A DC power source 8 and a resistor 9 are connected in series between the shaft 3 of the semiconductive roller 1 and the aluminum drum 6 to provide a measurement circuit 10. The DC power source 8 is connected to the shaft 3 at its negative terminal, and connected to the resistor 9 at its positive terminal. The resistor 9 has a resistance r of 100Ω.

Subsequently, a load F of 500 g is applied to opposite end portions of the shaft 3 to bring the semiconductive roller 1 into-press contact with the aluminum drum 6 and, in this state, a detection voltage V applied to the resistor 9 is measured by applying an application voltage E of DC 1000 V from the DC power source 8 between the shaft 3 and the aluminum drum 6 while rotating the aluminum drum 6 (at a rotation speed of 40 rpm).

The roller resistance R of the semiconductive roller 1 is calculated from the following expression (1') based on the detection voltage V and the application voltage E (=1000 V):

$$R=r\times E/(V-r) \quad (1')$$

However, the term (−r) in the denominator of the expression (1') is negligible, so that the roller resistance of the semiconductive roller 1 is expressed as a value calculated from the following expression (1) in the present invention:

$$R=r\times E/V \quad (1)$$

As described above, the ordinary temperature and ordinary humidity environment having a temperature of 23° C. and a relative humidity of 55%, the lower temperature and lower humidity environment having a temperature of 10° C. and a relative humidity of 20%, and the higher temperature and higher humidity environment having a temperature of 30° C. and a relative humidity of 80% are employed as conditions for the measurement.

The semiconductive roller 1 may be controlled as having a desired hardness and a desired compressive permanent set according to its use purpose. In order to control the hardness, the compressive permanent set, the roller resistance and the like, the mass ratio NBR/EPDM between the NBR and the EPDM may be controlled in the aforementioned range, or the types and the amounts of the sulfur, the peroxide crosslinking agent and the sulfenamide accelerating agent as the crosslinking component, or the types and the amounts of the carbon black, the filler and other component may be controlled.

The inventive semiconductive roller can be used not only as the developing roller but also as a charging roller, a transfer roller, a cleaning roller or the like, for example, in an electrophotographic image forming apparatus such as a laser printer, an electrostatic copying machine, a plain paper facsimile machine or a printer-copier-facsimile multifunction machine.

EXAMPLES

Example 1

Preparation of Rubber Composition

A rubber component was prepared by blending 50 parts by mass of an SBR (non-oil-extension type JSR1502 available from JSR Co., Ltd. and having a styrene content of 23.5%), 20 parts by mass of a GECO (EPION (registered trade name) 301 available from Daiso Co., Ltd. and having a molar ratio of EO/EP/AGE=73/23/4) and 30 parts by mass of a CR (SHOPRENE (registered trade name) WRT available from Showa Denko K.K.) The proportion of the SBR was 50 parts by mass and the proportion of the GECO was 20 parts by mass based on 100 parts by mass of the overall rubber component.

While 100 parts by mass of the rubber component was simply kneaded by means of a Banbury mixer, ingredients shown below in Table 1 except the crosslinking component were added to the rubber component, and then the crosslinking component was added to and further kneaded with the resulting mixture. Thus, a rubber composition was prepared.

TABLE 1

| Ingredients | Parts by mass |
|---|---|
| Ionic salt I | 0.05 |
| Sulfur powder | 0.75 |
| Thioureas | 0.85 |
| Accelerating agent DM | 0.50 |
| Accelerating agent TS | 1.00 |
| Accelerating agent DT | 0.80 |
| Electrically conductive filler | 5.00 |
| Acid accepting agent | 3.00 |

The ingredients shown in Table 1 are as follows. The amounts (parts by mass) shown in Table 1 are based on 100 parts by mass of the overall rubber component.

Ionic salt I: Potassium bis(trifluoromethanesulfonyl) imide

Sulfur powder: Sulfur crosslinking agent

Thioureas: Ethylene thiourea (2-mercaptoimidazoline ACCEL (registered trade name) 22-S available from Kawaguchi Chemical Industry Co., Ltd.

Accelerating agent DM: Di-2-benzothiazolyl disulfide (thiazole accelerating agent NOCCELER (registered trade name) DM available from Ouchi Shinko Chemical Industrial Co., Ltd.)

Accelerating agent TS: Tetramethylthiuram monosulfide (thiuram accelerating agent NOCCELER TS available from Ouchi Shinko Chemical Industrial Co., Ltd.)

Accelerating agent DT: 1,3-di-o-tolylguanidine (NOCCELER DT available from Ouchi Shinko Chemical Industrial Co., Ltd.)

Electrically conductive filler: Electrically conductive carbon black (DENKA BLACK (registered trade name) available from Denki Kagaku Kogyo K.K.)

Acid accepting agent: Hydrotalcites (DHT-4A (registered trade name) 2 available from Kyowa Chemical Industry Co., Ltd.)

(Production of Semiconductive Roller)

The rubber composition thus prepared was fed into an extruder, and extruded into a tubular body having an outer diameter of 17.0 mm and an inner diameter of 6.2 mm. Then, the tubular body was fitted around a temporary crosslinking shaft having an outer diameter of 7.5 mm, and crosslinked in a vulcanization can at 160° C. for 1 hour.

Then, the crosslinked tubular body was removed from the temporary shaft, then fitted around a shaft having an outer diameter of 10 mm and an outer peripheral surface to which an electrically conductive thermosetting adhesive agent was applied, and heated in an oven at 160° C. Thus, the tubular body was bonded to the shaft. In turn, opposite end portions of the tubular body were cut, and the outer peripheral surface of the resulting tubular body was polished by a traverse polishing method by means of a cylindrical polishing machine and then mirror-finished as having a surface roughness Rz of 5±2 μm and an outer diameter of 16.0 mm (with a tolerance of 0.05). Thus, a semiconductive roller unified with the shaft was produced.

Subsequently, the polished outer peripheral surface of the semiconductive roller was rinsed with water, and the semiconductive roller was set in a UV irradiation apparatus (PL21-200 available from Sen Lights Corporation) with its outer peripheral surface spaced 10 cm from a UV lamp. Then, the semiconductive roller was rotated about the shaft by 90 degrees at each time, and each 90-degree angular range of the outer peripheral surface was irradiated with ultraviolet radiation at wavelengths of 184.9 nm and 253.7 nm for 5 minutes. For each 90-degree angular range of the outer peripheral surface, this operation was performed four times. Thus, an oxide film was formed in the outer peripheral surface. In this manner, the semiconductive roller was completed.

Comparative Example 1

A rubber composition was prepared in substantially the same manner as in Example 1, except that the ionic salt I was not blended. Then, a semiconductive roller was produced in the same manner as in Example 1 by using the rubber composition thus prepared.

Examples 2 to 6 and Comparative Example 2

Rubber compositions were prepared in substantially the same manner as in Example 1, except that the proportion of the ionic salt I was 0.10 part by mass (Example 2), 0.20 parts by mass (Example 3), 1.00 part by mass (Example 4), 2.00 parts by mass (Example 5), 5.00 parts by mass (Example 6), and 6.00 parts by mass (Comparative Example 2) based on 100 parts by mass of the overall rubber component. Then, semiconductive rollers were respectively produced in the same manner as in Example 1 by using the rubber compositions thus prepared.

Example 7

A rubber composition was prepared in substantially the same manner as in Example 1, except that 0.2 parts by mass of lithium bis(trifluoromethanesulfonyl)imide (ionic salt II) based on 100 parts by mass of the overall rubber component was blended instead of the ionic salt I. Then, a semiconductive roller was produced in the same manner as in Example 1 by using the rubber composition thus prepared.

<Roller Resistance>

The roller resistances of each of the semiconductive rollers produced in Examples and Comparative Examples were measured in the lower temperature and lower humidity environment (LL at a temperature of 10° C. at a relative humidity of 20%), in the ordinary temperature and ordinary humidity environment (NN at a temperature of 23° C. at a relative humidity of 55%) and in the higher temperature and higher humidity environment (HH at a temperature of 30° C. at a relative humidity of 80%). In Tables 2 and 3, the roller resistances are shown in the form of log R.

Based on the measurement results, a difference (LL−HH) between a log $R_{LL}$ value for the roller resistance $R_{LL}$ measured in the lower temperature and lower humidity environment and a log $R_{HH}$ value for the roller resistance $R_{HH}$ measured in the higher temperature and higher humidity environment was determined, and the semiconductive rollers were each evaluated for the environment-dependent variations in roller resistance based on the following criteria:

◎: The difference in log R value was not greater than 1.2.

○: The difference in log R value was greater than 1.2 and not greater than 1.3.

Δ: The difference in log R value was greater than 1.3 and not greater than 1.4.

x: The difference in log R value was greater than 1.4.

<Actual Machine Test>

The semiconductive rollers produced in Examples and Comparative Examples were each incorporated in a new cartridge (integrally incorporating a toner container containing a toner, a photoreceptor body, and a developing roller kept in contact with the photoreceptor body) instead of the original developing roller for a commercially available laser printer, and the following test was performed. The laser printer utilized a positively-chargeable nonmagnetic single-component toner of grinding type, and had a printing speed of 26 sheets per minute (26 ppm) and a printable sheet number of 2600 (equivalent to a printer life) which is defined as the number of sheets on which an image can be successively printed at a printing percentage of 5%.

(Image Density in Steady State)

The new cartridge was mounted in the laser printer in an initial state. Then, an image was formed at a printing percentage of 5% successively on 50 sheets for warming up the laser printer in the ordinary temperature and ordinary humidity environment at a temperature of 23° C. at a relative humidity of 55% and, immediately thereafter, a black solid image was formed on a sheet.

Image densities were measured at given five points on the thus formed black solid image by means of a reflective densitometer (a combination of a light table LT20 and TECHKON RT120 available from Techkon GmbH), and averaged. The semiconductive rollers were each evaluated for image density in the steady state based on the following criteria.

○: The image density was not less than 1.9.

Δ: The image density was not less than 1.7 and less than 1.9.

x: The image density was less than 1.7.

(Image Density at Resumption)

After the image densities were measured in the aforementioned manner, the laser printer was switched off, and allowed to stand still in the lower temperature and lower humidity environment at a temperature of 10° C. at a relative humidity of 20% for 3 or more days. Then, the laser printer was switched on again and, immediately thereafter, a black solid image was formed on a sheet.

Image densities were measured at given five points on the thus formed black solid image by means of the reflective densitometer, and averaged. The semiconductive rollers were each evaluated for image density at the resumption of the image formation based on the following criteria.

○: The image density was not less than 1.9.

Δ: The image density was not less than 1.7 and less than 1.9.

x: The image density was less than 1.7.

(Contamination of Photoreceptor Body)

The semiconductive rollers produced in Examples and Comparative Examples were each incorporated in a new cartridge of the same type as described above instead of an original developing roller, and the resulting cartridge was sealed in an aluminum bag. After the cartridge was aged at 50° C. for 5 days in a gear oven, the cartridge was taken out of the aluminum bag, and further aged in the ordinary temperature and ordinary humidity environment at a temperature of 23° C. at a relative humidity of 55% for 8 hours.

Then, the resulting cartridge was mounted in the laser printer, and a halftone image having a one-dot and two-space pattern was formed successively on 20 sheets. Then, the sheets were each observed to check whether or not a nip mark of the semiconductive roller due to the contamination of the photoreceptor body was present in the formed image. The semiconductive rollers were each evaluated for the contamination of the photoreceptor body based on the following criteria:

○: A nip mark was found in none of the images formed on the 1st to 20th sheets.

Δ: A thin nip mark was found in the images formed successively on the 1st to 20th sheets, or a thick nip mark was found in the image formed on the 1st sheet but the nip mark was no longer found on the 20th sheet.

x: A thick nip mark was found in the images formed successively on the 1st to 20th sheets (Production Costs)

The semiconductive rollers of Examples and Comparative Examples were each evaluated for a production cost required for the production thereof based on the following criteria:

◎: The semiconductive roller was produced at a production cost increased by not greater than 10% over a production cost (standard cost) required for the production of the semiconductive roller of Example 1.

○: The semiconductive roller was produced at a production cost increased by greater than 10% and not greater than 20% over the standard cost.

Δ: The semiconductive roller was produced at a production cost increased by greater than 20% and not greater than 50% over the standard cost.

x: The semiconductive roller was produced at a production cost increased by greater than 50% over the standard cost.

The results are shown in Tables 2 and 3.

TABLE 2

| | Comparative Example 1 | Example 1 | Example 2 | Example 3 | Example 4 |
|---|---|---|---|---|---|
| | Parts by mass | | | | |
| SBR | 50 | 50 | 50 | 50 | 50 |
| GECO | 20 | 20 | 20 | 20 | 20 |

TABLE 2-continued

| | Comparative Example 1 | Example 1 | Example 2 | Example 3 | Example 4 |
|---|---|---|---|---|---|
| CR | 30 | 30 | 30 | 30 | 30 |
| Ionic salt I | — | 0.05 | 0.10 | 0.20 | 1.00 |
| Ionic salt II | — | — | — | — | — |
| Roller resistance (log R) | | | | | |
| LL | 8.4 | 8.3 | 8.1 | 7.9 | 7.4 |
| NN | 7.6 | 7.4 | 7.3 | 7.1 | 6.6 |
| HH | 7.0 | 7.0 | 6.9 | 6.7 | 6.3 |
| LL − HH | 1.4 | 1.3 | 1.2 | 1.2 | 1.0 |
| Evaluation | Δ | ○ | ◎ | ◎ | ◎ |
| Image density | | | | | |
| In steady state | ○ | ○ | ○ | ○ | ○ |
| At resumption | X | Δ | ○ | ○ | ○ |
| Contamination of photoreceptor body | ○ | ○ | ○ | ○ | ○ |
| Production cost | ◎ | ◎ | ◎ | ◎ | ◎ |

TABLE 3

| | Example 5 | Example 6 | Example 7 | Comparative Example 2 |
|---|---|---|---|---|
| Parts by mass | | | | |
| SBR | 50 | 50 | 50 | 50 |
| GECO | 20 | 20 | 20 | 20 |
| CR | 30 | 30 | 30 | 30 |
| Ionic salt I | 2.00 | 5.00 | — | 6.00 |
| Ionic salt II | — | — | 0.20 | — |
| Roller resistance (log R) | | | | |
| LL | 7.2 | 7.1 | 7.6 | 7.1 |
| NN | 6.4 | 6.3 | 6.8 | 6.3 |
| HH | 6.2 | 6.1 | 6.5 | 6.0 |
| LL − HH | 1.1 | 1.1 | 1.2 | 1.1 |
| Evaluation | ◎ | ◎ | ◎ | ◎ |
| Image density | | | | |
| In steady state | ○ | ○ | ○ | ○ |
| At resumption | ○ | ○ | ○ | ○ |
| Contamination of photoreceptor body | ○ | ○ | ○ | Δ |
| Production cost | ○ | Δ | ○ | X |

The results for Examples 1 to 7 and Comparative Example 1 in Tables 2 and 3 indicate that, where an ionic salt containing a cation and an anion including a fluoro group and a sulfonyl group in its molecule is blended in a rubber composition containing at least the SBR and the epichlorohydrin rubber in combination, it is possible to suppress the reduction in image density at the resumption of the image formation and, for further improvement of this effect, the proportion of the ionic salt to be blended should be not less than 0.05 parts by mass and is preferably not less than 0.1 part by mass based on 100 parts by mass of the overall rubber component.

The results for Examples 1 to 7 and Comparative Example 2 indicate that, in order to suppress the contamination of the photoreceptor body and the increase in production costs due to the addition of the ionic salt, the proportion of the ionic salt to be blended should be not greater than 5 parts by mass and is preferably not greater than 2 parts by mass based on 100 parts by mass of the overall rubber component.

Further, the results for Examples 3 and 7 indicate that not only the potassium salt but also the lithium salt is usable as the ionic salt.

This application corresponds to Japanese Patent Application No. 2014-115877 filed in the Japan Patent Office on Jun. 4, 2014, the disclosure of which is incorporated herein by reference in its entirety.

What is claimed is:

1. A semiconductive roller having a nonporous single-layer structure formed from a rubber composition which comprises:

a rubber component including a styrene butadiene rubber and an epichlorohydrin rubber; and a salt of an anion having a fluoro group and a sulfonyl group in its molecule;

wherein the salt is present in the rubber composition in a proportion of not less than 0.05 parts by mass and not greater than 5 parts by mass based on 100 parts by mass of the overall rubber component, wherein the styrene butadiene rubber is present in the rubber composition in a proportion of not less than 30 parts by mass and not greater than 80 parts by mass based on 100 parts by mass of the overall rubber component, and wherein the epichlorohydrin rubber is present in the rubber composition in a proportion of less than 50 parts by mass based on 100 parts by mass of the overall rubber component.

2. The semiconductive roller according to claim 1, wherein the rubber component further includes at least one selected from the group consisting of an acrylonitrile butadiene rubber, a chloroprene rubber, a butadiene rubber, an acryl rubber and an ethylene propylene diene rubber.

3. The semiconductive roller according to claim 1, wherein the proportion of the salt is not less than 0.1 part by mass and not greater than 2 parts by mass based on 100 parts by mass of the overall rubber component.

4. The semiconductive roller according to claim 2, wherein the proportion of the salt is not less than 0.1 part by mass and not greater than 2 parts by mass based on 100 parts by mass of the overall rubber component.

5. The semiconductive roller according to claim 1, further comprising an oxide film provided on an outer peripheral surface thereof.

6. An electrophotographic image forming apparatus for developing an electrostatic latent image formed on a surface of a photoreceptor body into a toner image with an electrically charged toner which includes as a developing roller the semiconductive roller according to claim 1.

* * * * *